US006485876B1

(12) United States Patent
Takezawa et al.

(10) Patent No.: US 6,485,876 B1
(45) Date of Patent: Nov. 26, 2002

(54) NON-MAGNETIC ONE-COMPONENT DEVELOPER AND DEVELOPING APPARATUS USING SAID DEVELOPER

(75) Inventors: Satoshi Takezawa, Kawasaki (JP); Tomoaki Tanaka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/631,680

(22) Filed: Aug. 2, 2000

(30) Foreign Application Priority Data

Oct. 20, 1999 (JP) ..... 11-298802

(51) Int. Cl.[7] ..... G03G 9/08

(52) U.S. Cl. ..... 430/110.4; 430/108.6; 430/108.7; 430/111.41; 399/284

(58) Field of Search ..... 430/110, 111, 430/137, 108.6, 108.7, 110.4, 111.41, 137.21, 108.1; 399/284

(56) References Cited

U.S. PATENT DOCUMENTS

| | | | | | |
|---|---|---|---|---|---|
| 4,973,540 | A | | 11/1990 | Macnida et al. | 430/110 |
| 5,219,694 | A | * | 6/1993 | Anno et al. | 430/110 |
| 5,503,954 | A | * | 4/1996 | Maruta et al. | 430/110 |
| 5,614,348 | A | * | 3/1997 | Inoue et al. | 430/120 |
| 5,702,858 | A | * | 12/1997 | Yuasa et al. | 430/106.6 |
| 5,802,428 | A | * | 9/1998 | Ohno et al. | 430/110 |
| 6,022,662 | A | * | 2/2000 | Matsumura et al. | 430/110.4 |
| 6,074,794 | A | * | 6/2000 | Fushimi et al. | 430/109 |
| 6,146,802 | A | * | 11/2000 | Okada et al. | 430/110 |
| 6,154,627 | A | * | 11/2000 | Iwamatsu et al. | 399/286 |

FOREIGN PATENT DOCUMENTS

| | | | |
|---|---|---|---|
| EP | 0 869 397 | | 7/1998 |
| JP | 7-219265 | | 8/1995 |
| JP | 7-239569 | | 9/1995 |
| JP | 11-258847 | * | 9/1999 |

OTHER PUBLICATIONS

JPO Abstract & Partial English –Language Translation of JP 11–258847 (Pub Sep. 1999), Includes Claims & Paragraphs 0001 to 0053. Sep. 1999.*

Derwent Marchined–Assisted Translation of JP 11–258847 (pub Sep. 1999).*

* cited by examiner

*Primary Examiner*—Janis L. Dote
(74) *Attorney, Agent, or Firm*—Armstrong, Westerman & Hattori, LLP

(57) ABSTRACT

A non-magnetic one-component developer is provided. This non-magnetic one-component developer includes toner particles and an external additive containing inorganic particles that adhere to the surface of each of the toner particles. In accordance with an emission analysis method utilizing fusion coupling plasma, the rate of free external additive that is determined by the ratio of the number of particles emitting light only from elements of the external additive to one toner particle is 9% or less by number. With such a non-magnetic one-component developer, the external additive will not be welded to the blade of a developing apparatus.

3 Claims, 3 Drawing Sheets

NON-MAGNETIC ONE-COMPONENT DEVELOPER AND DEVELOPING APPARATUS USING SAID DEVELOPER

BACKGROUND OF THE INVENTION

1. Field of the Invention

The present invention generally relates to non-magnetic one-component developers used in electrophotographic image forming apparatuses such as electrophotographic printers and copying machines. More particularly, the present invention relates to a non-magnetic one-component developer that can restrict the welding to peripheral equipment during a printing operation over a long period of time, and can prevent burring in printing and a decrease in image density.

2. Description of the Related Art

Conventionally, an electrophotographic image forming apparatus forms a latent image on a photosensitive drum by giving uniform electrostatic charges and then emitting light onto the surface of the photosensitive drum as a latent image carrier. The latent image is then materialized by the use of a developer containing coloring particles called toner, thereby forming a toner image. This toner image is then transferred and fixed onto a recording medium such as paper or transparent film.

To supply a developer onto the photosensitive drum in an image forming apparatus, a developing roller for transporting the developer is disposed adjacent to the photosensitive drum. This developing roller is provided with a blade for restricting the developer within a predetermined thickness.

The developer described above does not include carriers and is used for development only with toner particles. Such a developing technique is called a one-component developing technique. There are two types of toners used in the one-component developing technique: one is magnetic toner that has magnetism, and the other is non-magnetic toner that does not have magnetism. It is easier to simplify the structure of apparatus by a non-magnetic one-component developing technique using the non-magnetic toner. For this reason, intensive studies on the non-magnetic toner are being made these days.

However, there is a problem that the non-magnetic one-component developer often causes welding and adhesion to a blade of a developing apparatus. During a printing operation over a long period of time, the non-magnetic one-component developer is repeatedly brought into contact with the blade. As a result, the non-magnetic one-component developer adheres to the blade. Sometimes, the non-magnetic one-component developer even turns into lumps on the surface of the blade, and hinders the formation of a toner image on the developing roller. These lumps of the non-magnetic one-component developer cause white lines and unevenness in image density.

In order to solve the welding problem, many solutions have been suggested. For instance, Japanese Laid-Open Patent Application No. 4-368959 discloses a developer containing prescribed styrene-acrylic resin and propylene-1-butene copolymer. Japanese Laid-Open Patent Application No. 5-61245 discloses the use of positively charged additive particles. Japanese Laid-Open Patent Application No. 4-145448 discloses a technique of externally adding improved hydrophobic silica. Japanese Laid-Open Patent Application 5-107804 discloses a developer using a polymer containing acrylic acid nitrile. Japanese Laid-Open Patent Application No. 5-142857 discloses a toner having special surface properties.

The prior arts disclosed in the above references all concern improvements of the toner particles or the fine particles attached to the surface (hereinafter referred to as an "external additive") of each toner particle so as to control the charging properties and fluidity of the toner particles. In other words, all the inventions disclosed in the above references are to obtain a non-magnetic one-component developer that solves the welding problem.

However, all the prior arts have not succeeded to eliminate the welding problem completely. In order to solve the welding problem, the inventors of the present invention conducted a long-time printing test on a conventional non-magnetic one-component developer so as to find out the causes of the welding problem. More specifically, the elements constituting the welded substance adhering to the blade ware analyzed in great detail. Based on the results of the elemental analysis, it was found that the welded substance adhering to the blade contained more elements originating from the external additive than the non-magnetic one-component developer did. Although the cause of this is not clear, it is thought that many of the external additive particles were detached from the toner particles (those detached external additive particles will be hereinafter referred to as "free external additive"). The inventors assumed that it was the free external additive that caused adhesion to the blade. On this assumption, the inventors aimed to reduce the amount of free external additive that is detached from the toner particles, and have developed the present invention.

In order to make a more detailed analysis of the adhering substance, the inventors employed an emission analysis method using fusion coupling plasma. Examples of conventional quantifying techniques for free external additive particles include a technique of quantifying the amount of free external additive by subjecting toners dispersed in water to ultrasonic wave of predetermined power (disclosed in Japanese Laid-Open Patent Application No. 9-176232), and a technique of separating the external additive by performing air separation (disclosed in Japanese Laid-Open Patent Application No. 6-25836). According to either of those analyzing techniques, the external additive is forcibly separated from the surface of each toner particle. However, actual analysis of the condition of the non-magnetic one-component developer used in an image forming apparatus has not been made yet.

In view of this, the inventors of the present invention employed an emission analysis method using fusion coupling plasma, so as to analyze the developer having a condition closer to the actual condition of actual image formation. Based on the results of the emission analysis method, a more preferable non-magnetic one-component developer was obtained.

SUMMARY OF THE INVENTION

A general object of the present invention is to provide non-magnetic one-component developers in which the above disadvantages are eliminated.

A more specific object of the present invention is to provide a non-magnetic one-component developer of an electrophotographic image forming apparatus that does not cause welding to a blade during a printing operation over a long period of time and accordingly enables excellent image formation. The present invention is also to provide a developing apparatus using the non-magnetic one-component developer.

The above objects of the present invention are achieved by a non-magnetic one-component developer comprising:

toner particles; and an external additive containing inorganic particles that adhere to a surface of each of the toner particles, wherein, in accordance with an emission analysis method utilizing fusion coupling plasma, a proportion of free external additive particles that is determined by the number of detection events, in which light only from elements of the external additive is detected, is 9% or less by number.

With this non-magnetic one-component developer, an image having neither white lines nor uneven image density can be obtained, even after a long-time printing operation. The welding can be effectively prevented by the non-magnetic one-component developer. If the proportion of the free external additive particles exceeds 9% by number, such an excellent effect cannot be expected.

The above objects of the present invention are also achieved by a developing apparatus comprising:

a developing roller that transports the non-magnetic one-component developer of the present invention in a predetermined direction; and a metal blade that faces the surface of the developing roller and restricts the non-magnetic one-component developer within a predetermined thickness.

With this developing apparatus, excellent image formation can be carried out without causing welding, even after a continuous image forming operation over a long period of time.

The above and other objects and features of the present invention will become more apparent from the following description taken in conjunction with the accompanying drawings.

DESCRIPTION OF THE PREFERRED EMBODIMENTS

Figure 1:
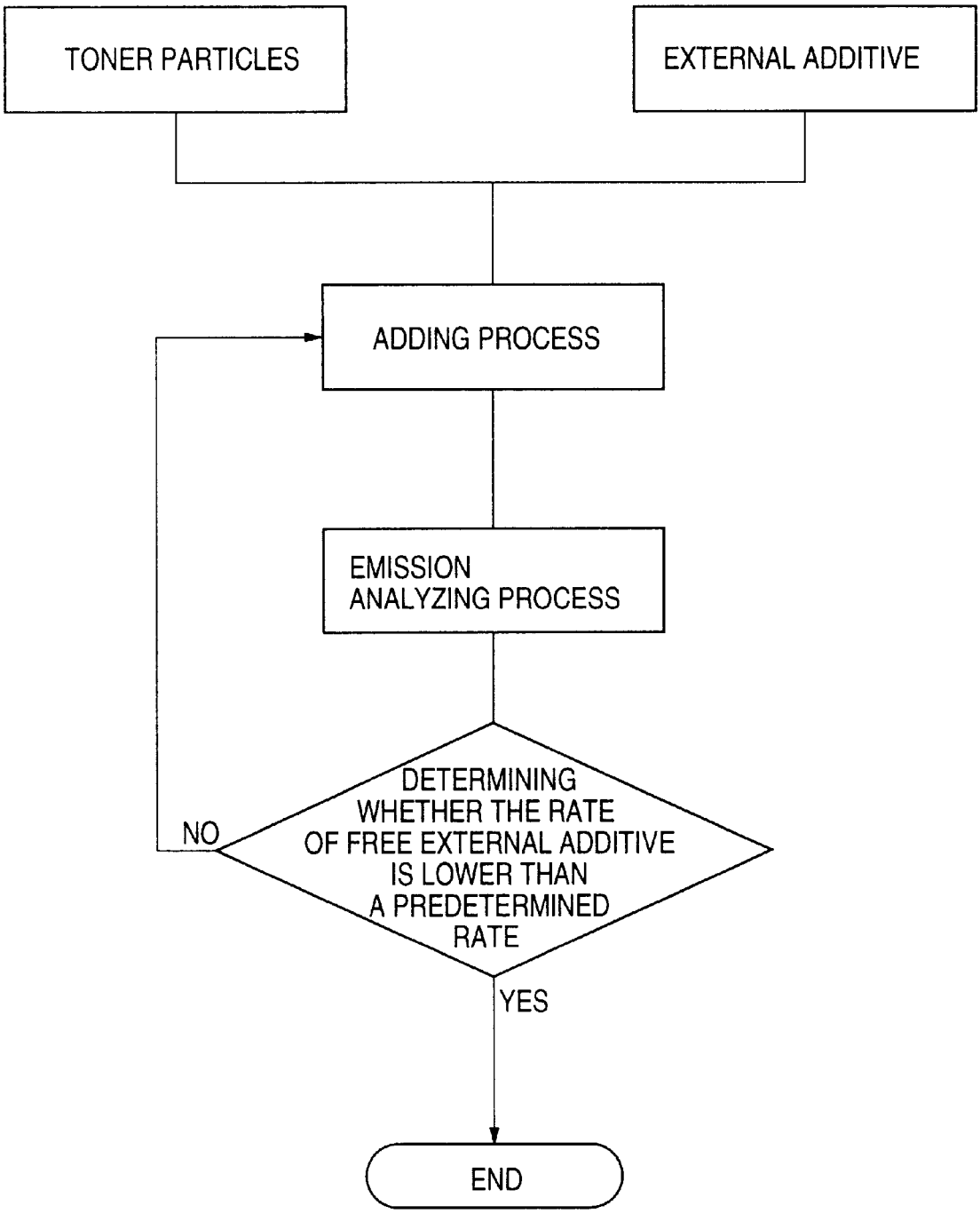
FIG. 1 is a flowchart of a manufacturing process of a non-magnetic one-component developer of the present invention.

The following is a description of embodiments of the present invention, with reference to the accompanying drawings.

The non-magnetic one-component developer of the present invention contains toner particles and an external additive made up of inorganic fine particles that adhere to the surface of each toner particle. The toner particles used in the present invention essentially comprise binder resin, colorant, a charge control agent, and a mold releasing agent. The toner particles may contain other additives. The raw material for the toner particles is a suitably adjusted conventional material.

The non-magnetic one-component developer of the present invention can be a monochrome toner or a color toner by the selective use of known colorant. The volume mean particle size of the toner particles is preferably 7.5 $\mu$m or greater. In the toner particles, the rate of toner particles having diameters of 1 $\mu$m to 4 $\mu$m is preferably 20% by number or less. This is because toner particles having diameters smaller than 7.5 $\mu$m is likely to result in an insufficient image density or defective transfer. Also, if the proportion of toner particles having diameters of 1 $\mu$m to 4 $\mu$m exceeds 20% by number, the external additive will be easily welded to a blade.

The binder resin is made of one or a combination of synthetic resin such as polyester resin, styrene resin, acrylic resin, styrene-acrylic resin, phenolic resin, silicone resin, epoxy resin, olefin resin, polyamide resin, and the like, and natural resin such as petroleum resin.

The colorant can be made of a known pigment or dye, such as carbon, phthalocyanine, benzimidazolone, quinacridone, nigrosine (azine dye), or chromium salicrylate complex (chrome dye). The amount of colorant contained in the toner particles should be decided in accordance with the tinting strength, the shape maintainability of the toner particles, and the splash of the toner.

The charge control agent can be made of a surface active agent containing fluorine atoms, a dye containing metal such as metal a salicrylate complex or azo-metal compound, or an azine dye such as a quaternary ammonium salt or nigrosine.

The mold releasing agent can be made of a paraffin compound, polyolefin resin, low molecular weight polypropylene, low molecular weight polyester resin, or the like.

The inorganic particles for the external additive can be made of one or a combination of inorganic compounds such as silica ($SiO_2$), titanium oxide ($TiO_2$), aluminum oxide ($Al_2O_3$), tin oxide (SnO), zinc oxide (ZnO), magnesium oxide (MgO), and the like.

The surface coverage rate of the external additive covering the surface of each toner particle is preferably in the range of 30% to 100%. If the surface coverage rate of the external additive is low, the fluidity of the toner particles tends to become lower. As a result, charging becomes insufficient, and the thickness of the toner particle layer on the developing roller is likely to be uneven. Furthermore, image fogging or blur might be caused. The surface coverage rate is the proportion of the total projected area of the external additive to the total surface area of each of the toner particles.

For the non-magnetic one-component developer of the present invention, an emission analysis method utilizing fusion coupling plasma is employed as a method of quantifying free external additive. Based on the detected value by the emission analysis method, the number of free external additive particles is controlled. The developer should be manufactured so that the proportion of the free external additive particles is 9% or less by number. The non-magnetic one-component developer having the above proportion of the free external additive particles will not cause welding to the blade during a printing operation over a long period of time.

A flowchart of the developer manufacturing process described so far is shown in FIG. 1.

Figure 2A:
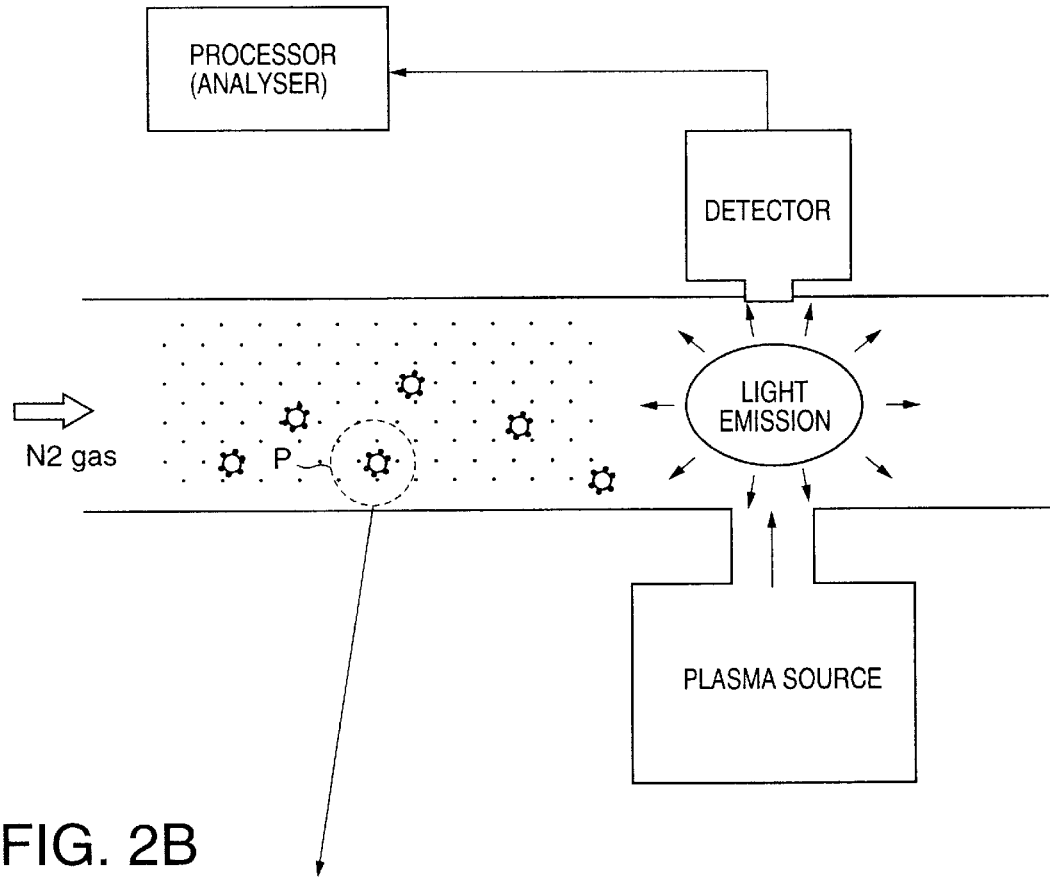
FIG. 2A illustrates an emission analysis method of detecting the proportion of free external additive particles in accordance with the present invention.

In the emission analysis method using fusion coupling plasma, the elements in the non-magnetic one-component developer are analyzed. In accordance with this method, a predetermined amount of non-magnetic one-component developer is transported, with a carrier gas such as nitrogen being used. FIG. 2A illustrates this emission analysis method using fusion coupling plasma. As shown in this figure, particles passing through an analyzing point are subjected to the plasma, and an elemental analysis is made based on the light emission from the particles.

Figure 2B:
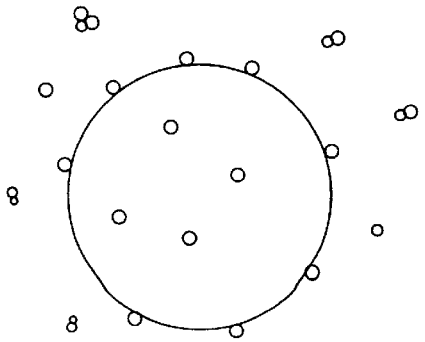
FIG. 2B is an enlarged view of a toner particle in the non-magnetic one component developer of the present invention.

FIG. 2B is an enlarged view of a toner particle (circled by a broken line P in FIG. 2A) in the non-magnetic one-component developer of the present invention. The particles to be analyzed by this emission analysis method include toner particles, the external additive particles adhering to the surfaces of the toner particles, and the free external additive particles separated from the toner particles. These particles emit light, and a detector detects the light emission.

Since the external additive made up of inorganic fine particles adheres to the surfaces of the toner particles, the light emission from a carbon atom contained in the toner particles, light emission from inorganic elements such as a silicon or titanium atom contained in the external additive should be simultaneously detected.

In an actual analysis of the non-magnetic one-component developer by the emission analysis method using fusion coupling plasma, however, particles which emit light originating only from inorganic elements such as silicon and titanium are detected. These particles are considered to be the free external additive particles separated from the toner particles.

The non-magnetic one-component developer is manufactured so that the proportion of free external additive particles is 9% by number. More specifically, the number of free external additive particles should be within the range of 0 to 9 among 100 particles (or particle groups) extracted randomly from the nonmagnetic one-component developer of the present invention. With the non-magnetic one-component developer thus manufactured, welding to the blade can be effectively prevented.

As an emission analyzing device for analyzing emission of fusion coupling plasma, a commercial particle analyzer such as PT-1000, produced by Yokogawa Electric Corp, can be employed. With this device, the amount of carbon, which is the main element of the toner particles, and the amount of silicon or titanium, which is the main element of the external additive, are measured. Elements that emit light are considered to be included in a group of particles, when the elements of the non-magnetic one-component developer are analyzed.

As described before, the non-magnetic one-component developer comprises the toner particles and the external additive that adheres to the surface of each of the toner particles. Accordingly, the analysis results by the emission analysis method should indicate the detection of the light emission from the carbon and the inorganic material such as silicon or titanium originating from the external additive. However, the particles that indicate only light emission from an inorganic material are also detected. Those particles are considered to be the free external particles detached from the toner particles.

The proportion of the free external additive particles is calculated by the following formula:

Free rate (%)="asynchronous count number"/("synchronous count number"+"asynchronous count number")×100 wherein the "synchronous count number" indicates the number of particles with which the light emission from carbon and the light emission from an inorganic material such as silicon or titanium are detected simultaneously, while the "asynchronous count number" indicates the number of the particles with which only the light emission from an inorganic material is detected.

Examples of the methods of manufacturing the non-magnetic one-component developer of the present invention include a method of milling and separating resin lumps in which colorant is dispersed, and a method of producing particles by polymerizing monomers to which the colorant is added.

As described before, the external additive is added to the surfaces of the toner particles so that the rate of the free external additive particles is restricted within a predetermined range. The mixing device used here can be a conventional device such as a ball mill, a V-type blender, or a high-speed stirrer. Where a Henschel mixer is used, for instance, a stirring process is performed at 1000 to 3000 rpm for 5 to 20 minutes, preferably at 1300 to 2300 rpm for 5 to 20 minutes, or more preferably at 1500 to 2000 rpm for 5 to 20 minutes.

As a pretreatment process performed prior to the stirring process, it is preferable to separate the fine particles of the external additive from each other. As the mixing process continues, the external additive adheres uniformly to the surfaces of the toner particles. However, a long-time process is not preferable in terms of the production costs. Therefore, the time of the mixing process should be only long enough to apply the external additive uniformly to the surfaces of the toner particles.

The amount of charges of the toner particles formed on the developing roller is controlled to be within the range of 3 to 30 $\mu$C/g, preferably within the range of 5 to 25 $\mu$C/g, or more preferably within the range of 6 to 20 $\mu$C/g. If the amount of charge for the toner particles is too great, the non-magnetic one-component developer on the developing roller easily becomes uneven in thickness. This might result in defective images such as uneven image density or image fogging. If the amount of charge for the toner particles is too small, on the other hand, the supply of the toner particles for the developing roller becomes insufficient, resulting in a low image density.

[First Embodiment]

A non-magnetic one-component developer of a first embodiment was produced, and printing was performed with a developing apparatus using the non-magnetic one-component developer of the first embodiment.

I. Preparation of Toner Particles

| Ingredients | parts by weight |
|---|---|
| binder resin: polyester resin | 93 |
| colorant: carbon black (BLACK PEARLS L produced by Cabot Co.) | 5 |
| charge control agent: S-34 produced by Orient Kagaku Kogyo K.K. | 1 |
| wax (mold releasing agent): BISCOL 550-P produced by Sanyo Kasei Kogyo K.K. | 1 |

The above ingredients were well stirred by a stirrer and then mixed by a two-shaft extruder, followed by cooling, rough grinding, fine grinding, and classification. As a result, toner particles having a volume mean particle size of 8 $\mu$m were obtained. The proportion of the particles having a diameter of 1 to 4 $\mu$m among the toner particles was detected by Coulter MULTISIZER (produced by Coulter Electronics Inc.) and was determined to be 15% by number.

II. Preparation of the External Additive

A mixture was obtained by adding 1.0 part by weight of hydrophobic silica and 0.4 part by weight of RA-200HS (produced by Nippon Aerosil K.K.) to 100 parts by weight of toner particles prepared in the above manner. The mixing process was then performed at 1900 rpm for 5 minutes, thereby obtaining the desired non-magnetic one-component developer. The proportion of the free external additive particles in the non-magnetic one-component developer was measured by the particle analyzer PT-1000, produced by Yokogawa Electric Corp., and was determined to be 4.2% by number.

III. Developing Apparatus

Figure 3:
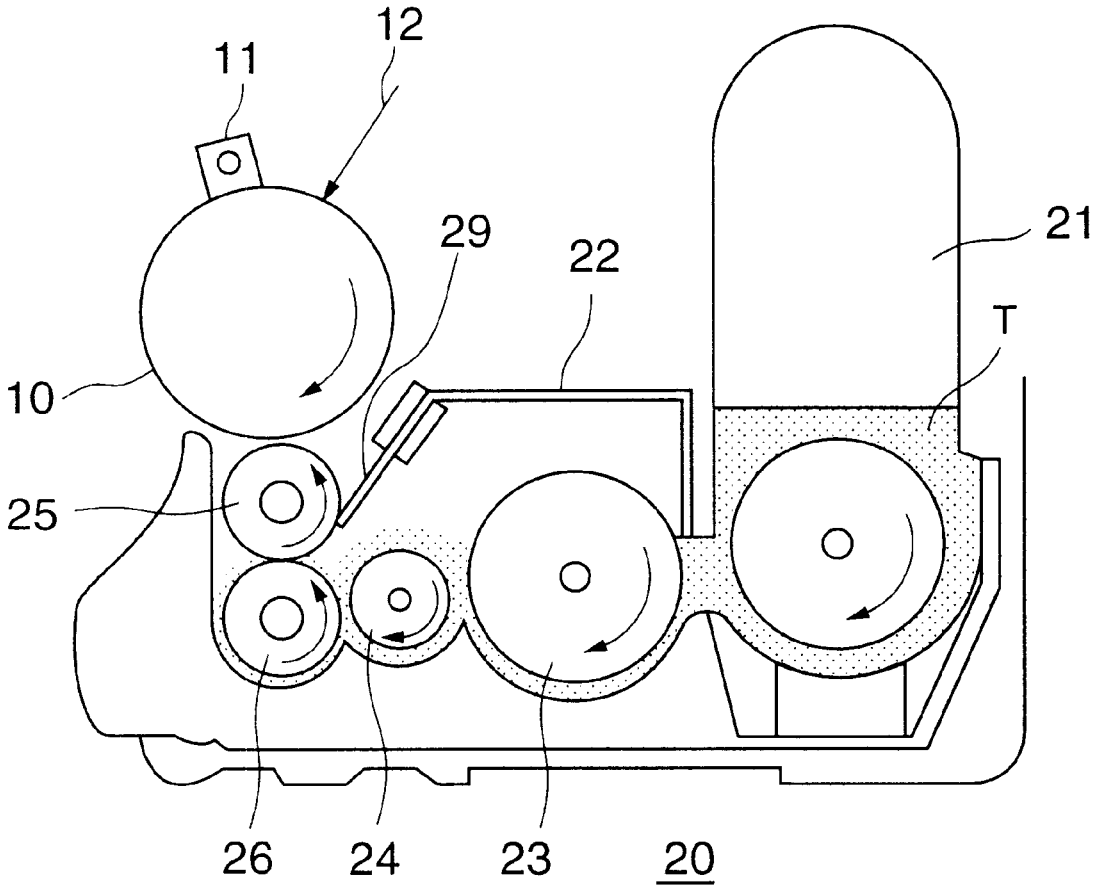
FIG. 3 is a schematic view of a developing apparatus in which the non-magnetic one-component developer of the present invention is used.

FIG. 3 is a schematic view of a developing apparatus used in the embodiments of the present invention.

This developing apparatus comprises a photosensitive drum 10 provided with a charger 11, an exposing unit 12, and a developing unit 20. A developer roller 25 disposed in the developing unit 20 faces the photosensitive drum 10. This developer roller 25 is made of urethane, and has surface roughness of 5 $\mu$m in the vertical direction and 10 $\mu$m in the circumferential direction.

The developing unit 20 comprises a developer container 21 and a developing main body 22. In the developing main body 22, an agitator roller 23 and a puddle roller 24 are disposed to stir a non-magnetic one-component developer T and to transport the developer T to the developer roller 25. Furthermore, a reset roller 26 is disposed between the puddle roller 24 and the developer roller 25. This reset roller 26 is pressed against the developer roller 25 at a resistance of $10^5\Omega$ to $10^{10}\Omega$. Thus, the reset roller 26 scrapes the residual developer T off the developer roller 25, and supplies the developer T onto the developer 25.

The developer roller 25 is provided with a blade 29 for restricting the thickness of the non-magnetic one-component developer T. The top end of this blade 29 is in contact with the surface of the developer roller 25, and is disposed in the counter direction to the rotative direction of the developing roller 25. The blade 29 is a plate-like metal member made of stainless steel (such as SUS304 or SUS631), brass, iron, aluminum, or copper, for instance. Considering corrosion resistance, durability, and hardness, SUS 304 is most desirable. The top end of the blade 29 is pressed against the surface of the developer roller 25 at a line pressure of 800±300 g/cm.

(Use of the Non-magnetic One-component Developer)

The non-magnetic one-component developer prepared in the above manner was used in a conventional printer (PRINTIA LASER XL-6000: produced by Fujitsu Ltd.) instead of the developing apparatus shown in FIG. 3. With this printer, a long-time continuous printing for 7000 sheets was carried out. The image density in the initial stage and the image density in the stage after the printing of 7000 sheets marked 1.3 or higher, and no image fogging was found. Also, the film-forming condition of the non-magnetic one-component developer T on the developer roller 25 was excellent, and no welding to the blade 29 occurred even after the printing of 7000 sheets. Accordingly, the obtained image had no white lines and density unevenness.

The amount of charge for the non-magnetic one-component developer on the developer roller 25 was detected by E-SPURT ANALYZER (produced by Hosokawa Micron K.K.). The initial charge was −9.2 $\mu$C/g, and the charge after the printing of 7000 sheets was −8.5 $\mu$C/g. Accordingly, there was only a little deterioration in charging.

[Second Embodiment]

In this embodiment, 0.7 part by weight of NAX50 (produced by Nippon Aerosil K.K.) was added to the external additive of the first embodiment. Other than that, a non-magnetic one-component developer was manufactured in the same manner as in the first embodiment. The proportion of free external additive particles in the non-magnetic one-component developer was measured by Particle Analyzer PT-1000 and was determined to be 7.2% by number.

With this non-magnetic one-component developer, the same printing test as in the first embodiment was carried out. The results were that no welding to the blade 29 occurred even after the 7000-sheet printing, and that no unevenness was found in the image density. The image density in the initial stage and the image density in the stage after the printing of 7000 sheets were high enough to avoid image fogging. Thus, excellent images were obtained.

[Third Embodiment]

In this embodiment, the mixing process of the external additive was performed at 1900 rpm for 10 minutes. Other than that, a non-magnetic one-component developer was manufactured in the same manner as in the second embodiment. The proportion of the free external additive particles in this non-magnetic one-component developer was measured by Particle Analyzer PT-1000, and was determined to be 3.1% by number.

With this non-magnetic one-component developer, the same printing test as in the first embodiment was performed. The results were that no welding to the blade 29 occurred even after the printing of 7000 sheets, and that no unevenness was found in the image density. The image densities in the initial stage and the stage after the printing of 7000 sheets were both high enough to avoid image fogging. Thus, excellent images were obtained.

[Comparative Example]

In this comparative example, the adding process of the external additive was performed at 1200 rpm for 3 minutes, that is, the number of revolutions was reduced and the processing time was shortened. Other than that, a non-magnetic one-component developer was manufactured in the same manner as in the first embodiment. The proportion of the free external additive particles in this non-magnetic one-component developer was measured by Particle Analyzer PT-1000, and was determined to be 9.8% by number. Here, lumps of white powder that appeared to be a condensate of silica were found in the non-magnetic one-component developer.

With this non-magnetic one-component developer, printing test was performed in the same manner as in the first embodiment. In the initial image forming stage, no white line appeared, and the image density was 1.3 or higher.

After the printing of 5000 sheets, however, white lines appeared in the image formed on the recording medium. At this point, the developing apparatus was disassembled, and deposits welded to the blade 29 were found. The layer of the non-magnetic one-component developer on the developer roller had thinned out. The thinned portions of the non-magnetic one-component developer layer corresponded to the white lines in the printed images. Thus, it was confirmed that a free external additive particle proportion higher than 9% by number caused the welding problem.

In the above embodiments, the present invention is applied to a black toner, but it should be understood that the present invention can also be applied to a color toner. Also, a printer was employed in the image forming tests in the above embodiments, but the non-magnetic one-component developer of the present invention can also be used in a copying machine.

The present invention is not limited to the specifically disclosed embodiments, but variations and modifications may be made without departing from the scope of the present invention.

The present application is based on Japanese priority application No. 11-298802, filed on Oct. 20, 1999, the entire contents of which are hereby incorporated by reference.

What is claimed is:

1. A non-magnetic one-component developer comprising:

toner particles; and an external additive containing inorganic particles that adhere to a surface of each of the toner particles, wherein, in accordance with an emission analysis method utilizing fusion coupling plasma, a proportion of a free external additive that is determined by a proportion of detection events, in which light emitted only from elements of the external additive is detected, is in the range of 3.1–7.2% by number, said non-magnetic developer having an absolute charge of 6 to 20 $\mu$C/g, said toner particles having a volume mean particle size of 7.5 $\mu$m or greater, the rate of toner particles having diameters of 1–4 $\mu$m being 20% or less by number, and a surface coverage rate of the external additive covering a surface of each of the toner particles is 30% to 100%.

2. The non-magnetic one-component developer as claimed in claim 1, wherein the emission analysis method comprises the steps of:

transporting a predetermined amount of said non-magnetic one-component developer together with a carrier gas;

subjecting particles passing through an analyzing point to fusion coupling plasma; and making an elemental analysis based on light emission from the particles.

3. A developing apparatus comprising:

a developing roller that transports a non-magnetic one-component developer in a predetermined direction;

a metal blade that faces a surface of the developing roller and restricts the non-magnetic one-component developer within a predetermined thickness, wherein:

the non-magnetic one-component developer contains toner particles and an external additive including inorganic particles that adhere to a surface of each of the toner particles; and a proportion of free external additive that is determined by an emission analysis method utilizing fusion coupling plasma, as the number of detection events, in which light emitted only from elements of the external additive is detected, is in the range of 3.1–7.2% by number, said non-magnetic developer having an absolute charge of 6 to 20 $\mu$C/g, and a surface coverage rate of the external additive covering a surface of each of the toner particles is 30% to 100%.

* * * * *